United States Patent [19]

Grab

[11] 4,334,635

[45] Jun. 15, 1982

[54] MACHINE FOR DISPENSING BULK MERCHANDISE

[76] Inventor: Martin Grab, Hildastrasse 6, D-6921 Michelfeld, Angelbachtal, Fed. Rep. of Germany

[21] Appl. No.: 159,645

[22] Filed: Jun. 16, 1980

[51] Int. Cl.[3] ..... B65H 3/00; G07F 11/16

[52] U.S. Cl. ..... 221/194; 221/264; 222/354

[58] Field of Search ..... 221/265, 191, 194, 195, 221/196, 294, 264, 263; 222/354, 355, 361

[56] References Cited

U.S. PATENT DOCUMENTS

| | | | |
|---|---|---|---|
| 895,516 | 8/1908 | Tucker | 222/354 |
| 1,974,988 | 9/1934 | Hillstrom | 222/354 X |
| 2,652,916 | 9/1953 | Mason | 221/265 X |
| 2,852,167 | 9/1958 | Lempart | 222/354 |
| 4,168,019 | 9/1979 | Hausam | 222/354 X |

FOREIGN PATENT DOCUMENTS

| | | | |
|---|---|---|---|
| 2910838 | 9/1980 | Fed. Rep. of Germany | 221/194 |

*Primary Examiner*—Allen N. Knowles
*Attorney, Agent, or Firm*—Kurt Kelman

[57] ABSTRACT

A machine for dispensing bulk merchandise comprises a dispensing chute comprised of a horizontally extending wall part and a merchandise dispensing receptacle attached thereto, and a vertically extending wall part extending upwardly from the horizontally extending wall part. The receptacle is movable through a discharge opening in the bottom of a housing containing the chute between a retracted and a forward, dispensing position, and the vertically extending wall part is pivotally connected to the horizontally extending wall part for movement therewith upon movement of the receptacle. A cut-off slide is movable with the receptacle between a retracted and a forward, cut-off position for cutting off delivery of merchandise from a hopper into the chute when the receptacle is moved into the forward position. A stop prevents the horizontally extending wall part from projecting beyond the discharge opening when the same is moved into the forward position wherein the receptacle projects therebeyond.

3 Claims, 4 Drawing Figures

MACHINE FOR DISPENSING BULK MERCHANDISE

Figure 1:
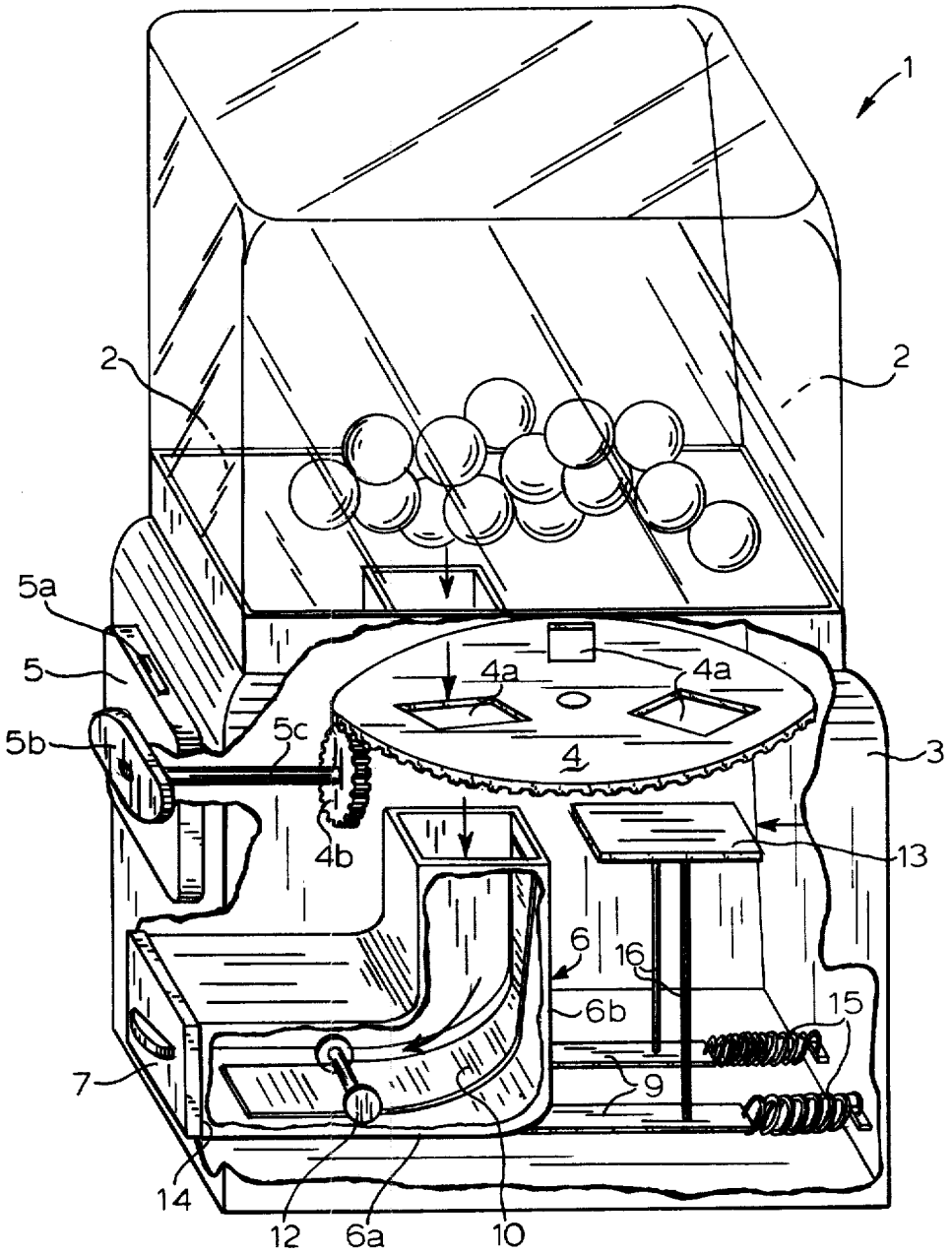

The present invention relates to a machine for dispensing bulk merchandise, such as chewing gum, nuts and the like.

Many types of such dispensing machines have become widely used and, in general, these machines have a merchandise dispensing chute closed by a pivotal flap which can be opened by a coin-operated mechanism to enable the merchandise to be removed manually from the chute after the flap is opened. It has been found that these machines can be readily damaged, that the operating mechanism may be manipulated by wires and rods without depositing money to dispense merchandise, and that the manual withdrawal of the merchandise from the chute is unsanitary since it permits the inside of the chute to be soiled.

It is a primary object of this invention to overcome these disadvantages, to enable the merchandise to be removed without the hands of the user entering the dispensing chute and, at the same time, to make the machine tamper-proof and less subject to damage.

The above and other objects are accomplished with a machine for dispensing bulk merchandise, which comprises a housing defining a bottom discharge opening, a hopper storing the bulk merchandise and a merchandise dispensing chute mounted in the housing and extending between the hopper and the discharge opening. According to the invention, the chute comprises a substantially horizontally extending wall part and a merchandise dispensing portion attached thereto, and a substantially vertically extending wall part extending upwardly from the horizontally extending wall part. The dispensing portion is movable through the discharge opening between a retracted and a forward, dispensing position, and the vertically extending wall part is pivotally connected to the horizontally extending wall part for movement therewith upon movement of the merchandise dispensing portion. A merchandise distributing device is arranged between the hopper and the chute for delivering the bulk merchandise from the hopper into the chute and a cut-off slide is movable with the wall parts between a retracted position and a forward cut-off position, the slide being arranged between the merchandise distributing device and the dispensing chute for cutting off delivery of the merchandise into the chute when the merchandise dispensing portion with the horizontally extending wall part is moved into the forward position. A stop is arranged to prevent the horizontally extending wall part from projecting beyond the discharge opening when the same is moved into the forward piston wherein the merchandise dispensing portion projects therebeyond.

The merchandise dispensing portion comprises a receptacle defining a downwardly directed merchandise dispensing port and arranged to receive the merchandise through the chute, this receptacle being forwardly slidable or upwardly pivotal. Upon forward sliding or upward pivoting of the merchandise dispensing portion the merchandise will fall through the port into a hand held therebelow and it will not be necessary for the merchandise to be removed from the chute by inserting the hand thereinto. Thus, the chute will never be touched. Furthermore, tampering will be minimized or entirely prevented and the interior of the machine will always remain out of manual reach, thus reducing damage to the machine.

Figure 2:
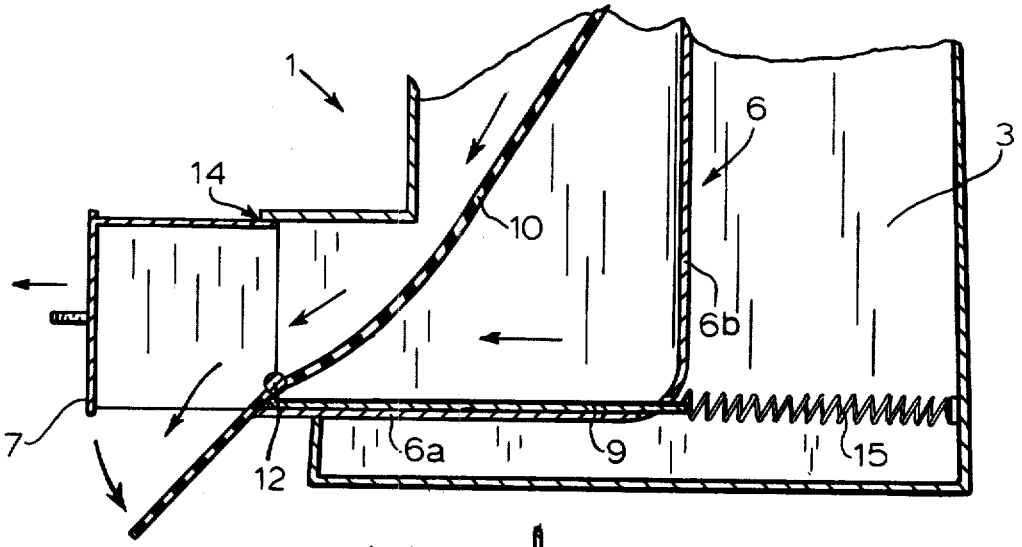
Figure 3:
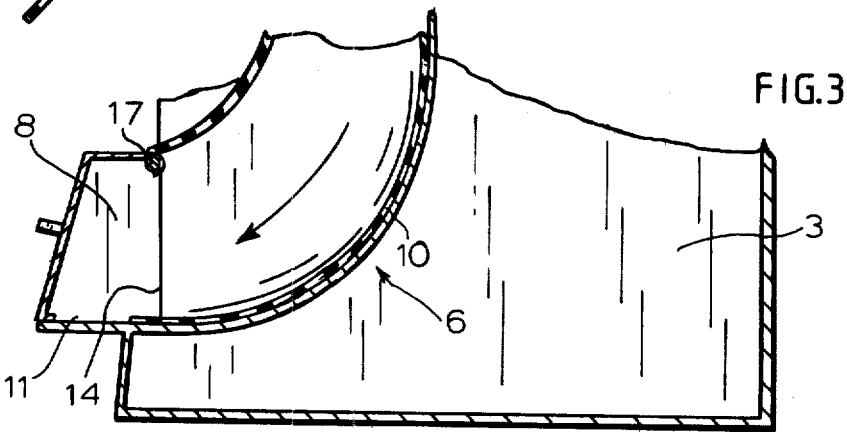
Figure 4:
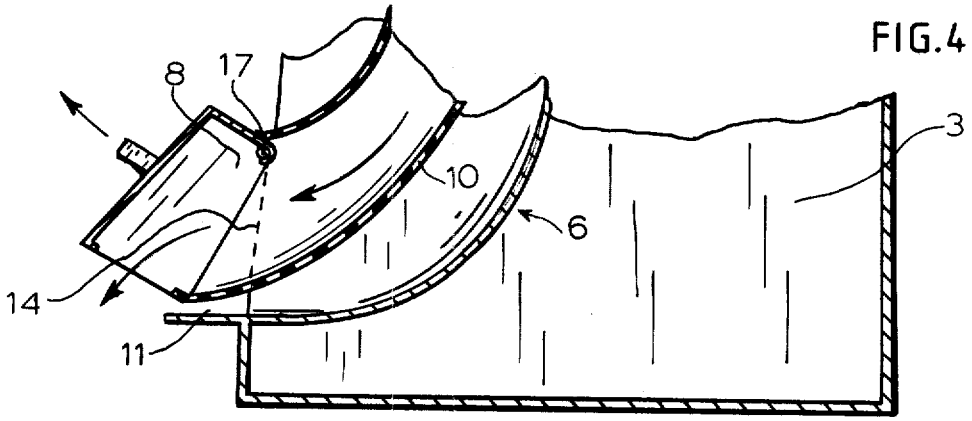

The above and other objects, advantages and features of the present invention will become more apparent from the following description of two now preferred embodiments thereof, taken in conjunction with the accompanying drawing wherein FIG. 1 is a perspective view of a merchandise dispensing machine according to this invention, showing one embodiment of the merchandise dispensing portion, the housing walls being broken away to show the structures in the interior of the machine housing and the merchandise dispensing portion being in the retracted position, FIG. 2 shows the machine of FIG. 1 in vertical section, with the merchandise dispensing portion in the forward, dispensing position, FIG. 3 is a like section of the lower part of the machine showing another embodiment of the merchandise dispensing portion in retracted position, and FIG. 4 shows the same view, with the merchandise dispensing portion in the upwardly pivoted position.

Referring now to the drawing and first to FIG. 1, machine 1 for dispensing bulk merchandise, such as chewing gum, nuts, candy or the like (not shown), comprises housing 3 defining bottom discharge opening 14 in a side wall thereof. The housing walls will normally be made of an opaque rigid synthetic resin or of metal. The open-topped housing carries hopper 2 storing the bulk merchandise and this hopper is conventionally made of a transparent rigid synthetic resin and may be periodically removed for refilling in a well known manner forming no part of the present invention.

Merchandise dispensing channel 6 is mounted in the housing and extends between hopper 2 and discharge opening 14, this channel comprising substantially horizontally extending part 6*a* and substantially vertically extending part 6*b*. According to this invention, merchandise dispensing chute 10 is arranged in the channel. This chute comprises a substantially horizontally extending wall part and merchandise dispensing portion 7 attached thereto, and a substantially vertically extending wall part extending upwardly from the horizontally extending wall part. In the illustrated embodiment, chute 10 consists of a flexible synthetic resin band so that the vertically extending part is pivotally connected to the horizontally extending part. Functionally equivalent to this unitary chute construction, the horizontally and vertically extending wall parts may be rigid walls interconnected by a flexible hinge portion forming a knee and connecting the two rigid walls to each other.

Merchandise distributing device 4 is arranged between hopper 2 and chute 10 for delivering the bulk merchandise from the hopper into the chute. The illustrated merchandise distributing device is of a conventional type and comprises a crown gear defining a series of ports 4*a* spaced about the axle of the gear. The crown gear is mounted in the bottom of the hopper eccentrically in relation to chute 10 so that respective ports 4*a* may be brought into registry with the inlet of the chute for permitting merchandise to pass through the port into the chute on rotation of the crown gear.

The illustrated machine is coin-operated in a generally conventional manner, for which purpose it comprises coin-operated mechanism 5 having a coin-receiving slot 5*a* and including a rotary handle 5*b* which may be rotated upon insertion of a coin into slot 5*a*. The handle is keyed to axle 5*c* whose free inner end carries pinion 4b in mesh with the crown gear 4. Each rotation of handle 5b will cause a respective port 4a to be brought into registry with the inlet of chute 10 so the merchandise will fall through the port thereinto.

As shown in FIGS. 1 and 2, merchandise dispensing portion 7 is movable through discharge opening 14 between a retracted position (shown in FIG. 1) and a forward, dispensing position (shown in FIG. 2) and the vertically extending wall part of chute 10 is pivotally connected to the horizontally connected wall part for movement therewith upon movement of the merchandise dispensing portion, thus assuming an oblique position tilting towards the discharge opening.

Cut-off slide 13 is movable with merchandise dispensing portion 10 between a retracted position (shown in FIG. 1) and a forward, cut-off position (shown in FIG. 2). The slide is arranged between the merchandise distributing device and dispensing chute 10 for cutting off delivery of the merchandise into the chute when the merchandise dispensing portion with the horizontally extending wall part of the chute is moved into the forward position.

Stop 12 is arranged in merchandise dispensing channel 6 and extends across the horizontally extending wall part of chute 10 near discharge opening 14 to prevent the horizontally extending chute wall part from projecting beyond the discharge opening when this part is moved into the forward position wherein merchandise dispensing portion 7 projects therebeyond.

In the embodiment of FIG. 1, the merchandise dispensing portion comprises slidable receptacle 7 defining downwardly directed merchandise discharge port 11 and arranged to receive the merchandise through the chute. Guide rod means illustrated as a pair of rods 9 is attached to receptacle 7 and extends rearwardly of chute 10. Retracting means illustrated as coil spring 15 attaches the rods to the back wall of housing 3 to bias the receptacle into the retracted position while permitting forward movement thereof against the bias of the retracting means. As shown, connecting rods 16 rigidly connect rods 9 to slide 13 so that the slide is movable with merchandise dispensing portion 7.

In operation, when it is desired to dispense merchandise from hopper 2, a coin is inserted into slot 5a, rotary handle 5b is operated to rotate crown gear 4 through pinion 4b, thus bringing a port 4a into registry with channel 6, and merchandise dispensing receptacle 7 is pulled forward to permit the merchandise that has fallen through port 4a into chute 10 to be withdrawn through dispensing port 11 in receptacle 7, further delivery of merchandise from hopper 2 being interdicted by forwardly pulled slide 13.

The merchandise dispensing portion in the embodiment of FIGS. 3 and 4 comprises receptacle 8 defining downwardly directed merchandise dispensing port 11' and arranged to receive the merchandise through the chute. In a manner functionally equivalent to the slidable mounting of receptacle 7, receptacle 8 is mounted for upward pivoting into the forward, dispensing position (shown in FIG. 4), the means for retracting the upwardly pivoted receptacle (not shown) being substantially the same as in the first-described embodiment. As shown, receptacle 8 is hinged at 17 to the wall of housing 3 at discharge opening 14. In all other respects, the machine is the same as that hereinabove described.

What I claim is:

1. A machine for dispensing bulk merchandise, which comprises (a) a housing defining a bottom discharge opening, (b) a hopper storing the bulk merchandise, (c) a merchandise dispensing chute mounted in the housing and extending between the hopper and the discharge opening, the chute comprising (1) a substantially horizontally extending wall part and a merchandise dispensing portion attached thereto, and (2) a substantially vertically extending wall part extending upwardly from the horizontally extending wall part, the dispensing portion being movable through the discharge opening between a retracted and a forward, dispensing position, and the vertically extending wall part being pivotally connected to the horizontally extending wall part for movement therewith upon movement of the merchandise dispensing portion, (d) a merchandise distributing device arranged between the hopper and the chute for delivering the bulk merchandise from the hopper into the chute, (e) a cut-off slide movable with the merchandise dispensing portion between a retracted position and a forward, cut-off position, the slide being arranged between the merchandise distributing device and the dispensing chute for cutting off delivery of the merchandise into the chute when the merchandise dispensing portion with the horizontally extending wall part is moved into the forward position, and (f) a stop arranged to prevent the horizontally extending wall part from projecting beyond the discharge opening when the same is moved into the forward position wherein the merchandise dispensing portion projects therebeyond.

2. The bulk merchandise dispensing machine of claim 1, wherein the merchandise dispensing portion comprises a slidable receptacle defining a downwardly directed merchandise discharge port and arranged to receive the merchandise through the chute, guide rod means attached to the receptacle and extending rearwardly of the chute, and retracting means attached to the guide rod means and biasing the receptacle into the retracted position while permitting the forward movement thereof against the bias of the retracting means.

3. The bulk merchandise dispensing machine of claim 1, wherein the merchandise dispensing portion comprises a receptacle defining a downwardly directed merchandise dispensing port and arranged to receive the merchandise through the chute, the receptacle being mounted for upward pivoting into the forward, dispensing position, and means for retracting the upwardly pivoted receptacle.

* * * * *